US005657033A

United States Patent [19]

Young

[11] Patent Number: 5,657,033

[45] Date of Patent: Aug. 12, 1997

[54] COFIRED CERAMIC NOTCH AND HORN ANTENNAS

[75] Inventor: Brian D. Young, Austin, Tex.

[73] Assignee: Hughes Electronics, Los Angeles, Calif.

[21] Appl. No.: 482,335

[22] Filed: Jun. 7, 1995

[51] Int. Cl.[6] ..... H01Q 13/00; H01Q 13/10

[52] U.S. Cl. ..... 343/786; 343/767

[58] Field of Search ..... 343/700 MS, 742, 343/767, 770, 772, 778, 786, 867; H01Q 13/00, 13/10

[56] References Cited

U.S. PATENT DOCUMENTS

| | | | |
|---|---|---|---|
| 4,199,764 | 4/1980 | Williams et al. | 343/786 |
| 4,408,208 | 10/1983 | Dumas | 343/786 |
| 5,264,860 | 11/1993 | Quan | 343/767 |
| 5,311,199 | 5/1994 | Fraschilla et al. | 343/767 |
| 5,426,442 | 6/1995 | Haas | 343/778 |
| 5,552,797 | 9/1996 | Cook | 343/786 |

*Primary Examiner*—Donald T. Hajec
*Assistant Examiner*—Tan Ho
*Attorney, Agent, or Firm*—Leonard A. Alkov; Wanda K. Denson-Low

[57] ABSTRACT

A microwave horn antenna structure including a plurality of planar dielectric insulating layers stacked in laminar fashion so as to have a bottom layer and a top layer, respective similarly shaped conductive trace loops co-axially disposed on a plurality of contiguous ones of the insulating layers and of incrementally increasing size from a lowermost conductive trace loop an uppermost conductive trace loop, and a plurality of conductive vias extending through the planar dielectric layers for electrically interconnecting the respective conductive trace loops. Also disclosed is a flared notch antenna that includes a plurality of planar dielectric insulating layers stacked in laminar fashion, a slanted column of electrically interconnected conductive vias formed in a plurality of contiguous ones of the dielectric insulating layers and a second slanted column of electrically interconnected conductive vias formed in the contiguous ones of the dielectric insulating layers.

7 Claims, 3 Drawing Sheets

COFIRED CERAMIC NOTCH AND HORN ANTENNAS

BACKGROUND OF THE INVENTION

The disclosed invention is directed generally to notch and horn antennas, and more particularly to cofired ceramic notch and horn antenna structures.

Notch and horn antennas provide for wide bandwidths, and are commonly utilized in radar applications because of their wide bandwidths. However, notch and horn antennas are commonly machined and tend to be intricate, expensive, and bulky. Notch antennas have been implemented as planar conductors formed on a dielectric substrate, for example by photolithographic techniques, but such structures tend to be bulky. AS a result of the bulky size of known notch and horn antennas, they are not amenable for use in conformal phased arrays which have been implemented with planar antennas that typically have narrow bandwidths.

SUMMARY OF THE INVENTION

It would therefore be an advantage to provide notch and horn antenna structures that are inexpensive and space efficient.

Another advantage would be to provide notch and horn antenna structures that are suitable for conformal phased array applications.

The foregoing and other advantages are provided by the invention in a microwave antenna structure that is formed in a co-fired integrally fused unitized multilayer circuit structure. A horn antenna in accordance with the invention includes a plurality of planar dielectric insulating layers stacked in laminar fashion so as to have a bottom layer and a top layer, respective similarly shaped conductive trace loops co-axially disposed on a plurality of contiguous ones of the insulating layers and of incrementally increasing size from a lowermost conductive trace loop an uppermost conductive trace loop, and a plurality of conductive vias extending through the planar dielectric layers for electrically interconnecting the respective conductive trace loops. A flared notch antenna in accordance with the invention includes a plurality of planar dielectric insulating layers stacked in laminar fashion, a slanted column of electrically interconnected conductive vias formed in a plurality of contiguous ones of the dielectric insulating layers and a second slanted column of electrically interconnected conductive vias formed in the contiguous ones of the dielectric insulating layers.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1A:
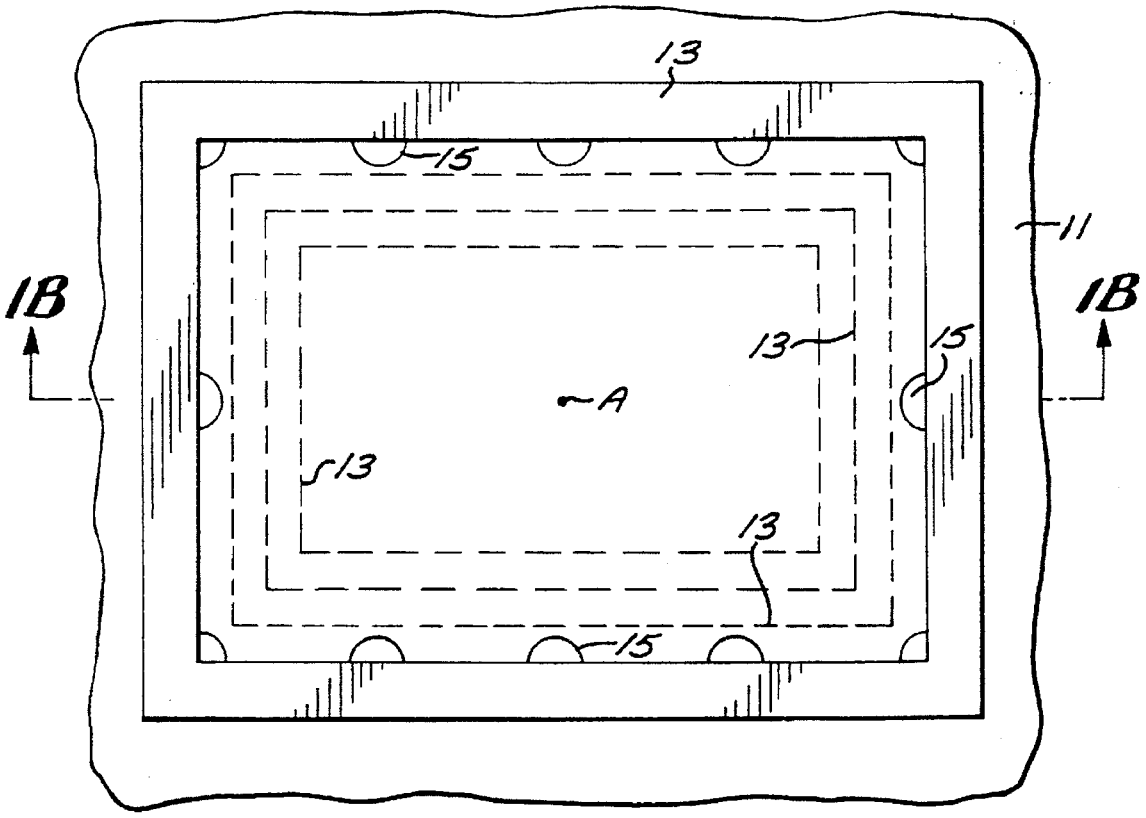
FIGS. 1A and 1B schematically illustrate a horn antenna in accordance with the invention.

In the following detailed description and in the several figures of the drawing, like elements are identified with like reference numerals.

The subject invention is implemented in a unitized multilayer circuit structure that is utilized for interconnecting various discrete circuits mounted on the outside of the unitized structure. The unitized multilayer circuit structure is formed from a plurality of dielectric layers (comprising ceramic, for example), conductive traces disposed between the layers, and conductive vias formed in the layers which together with any buried elements (e.g., elements formed on the top of a dielectric layer and covered by an overlying dielectric layer) are processed to form an integrally fused unitized multilayer structure. After the unitizing fabrication, appropriate metallization, including for example ground plane metallization, is applied to the outside of the unitized structure, and the discrete circuits are mounted and electrically connected.

Figure 1B:
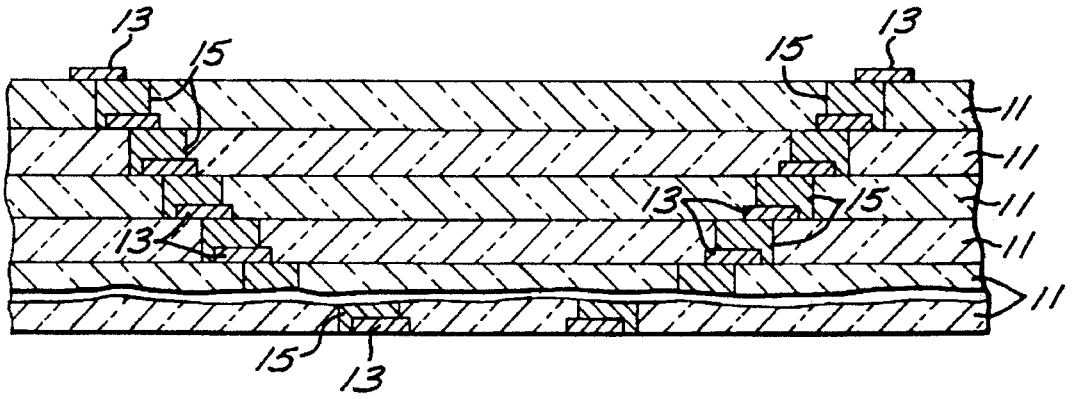

Referring now to FIGS. 1A and 1B, set forth therein are a simplified top plan view and an elevational schematic cross sectional view of an illustrative example of a horn antenna structure in accordance with the invention which includes a polygon shaped cross section. The horn antenna structure includes a plurality of planar dielectric insulating layers 11 stacked in laminar fashion to form a substrate. The planar dielectric insulating layers are arranged in a sequence from a bottom layer to a top layer. A plurality of co-axial conductive metallized strip loops 13 are respectively formed on each of a plurality of contiguous ones of the dielectric insulating layers, wherein each conductive metallized strip loop is an elongated metallized trace that is shaped in the form of a closed path or figure.

The plurality of metallized strip loops 13 are centered on an axis A that is orthogonal to the planar extent of the insulating layers, and are of incrementally increasing size from the lowermost conductive metallized strip loop 13 to the uppermost conductive metallized strip loop 13, wherein the lowermost conductive metallized strip loop 13 is the conductive metallized strip loop that is lowest in the stack of insulating layers and the uppermost conductive metallized strip loop 13 is uppermost in the stack of insulating layers. Size refers to the length or extent of a loop as measured along the loop. In the top plan view of FIG. 1A, the conductive metallized strip loop 13 disposed on the top dielectric insulating layer 11 is the uppermost conductive metallized strip loop and is shown in solid lines, while the inside edges of several of the underlying conductive metallized strip loops 13 are schematically depicted by broken lines.

Figure 2:
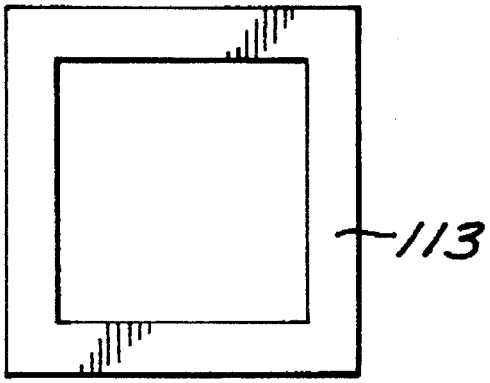
FIG. 2 schematically illustrates that each of the coaxial conductive metallized strip loops of the horn antenna of FIGS. 1A and 1B can comprise the sides of a square.
Figure 3:
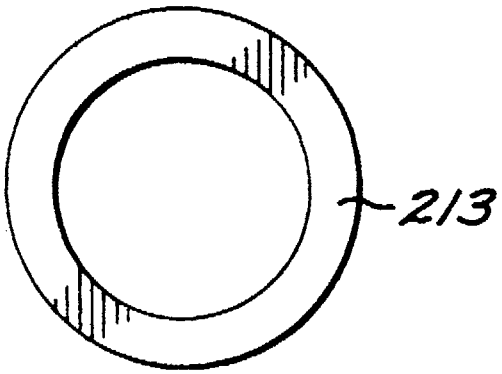
FIG. 3 schematically illustrates that each the coaxial conductive metallized strip loops of the horn antenna of FIGS. 1A and 1B can comprise a circular conductive metallized strip loop.
Figure 4:
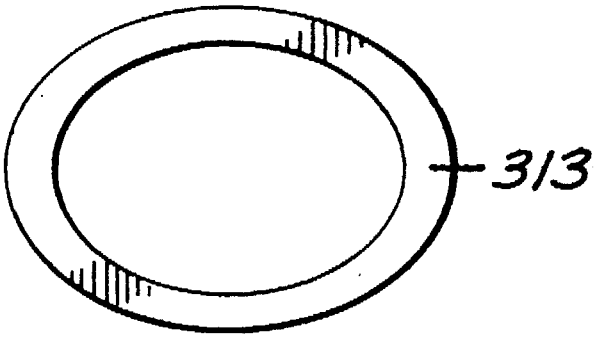
FIG. 4 schematically illustrates that each the coaxial conductive metallized strip loops of the horn antenna of FIGS. 1A and 1B can comprise an elliptical conductive metallized strip loop.

By way of illustrative example, each of the conductive metallized strip loops 13 comprises the sides of a polygon, as illustrated in FIGS. 1A and 1B for the particular example wherein each conductive metallized strip loop 13 forms the sides of a rectangle. Each of the conductive metallized strip loops 13 can also comprise the sides of a square in the form of a square shaped conductive metallized strip loop 113 schematically illustrated in FIG. 2. By way of further example, each of the metallized strip loops 13 comprises a closed curved figure, such as a circular conductive metallized strip loop 213 schematically illustrated in FIG. 3, wherein the metallized strip loop 213 is in the form or outline of a circle, or an elliptical conductive metallized strip loop 313 schematically illustrated in FIG. 4, wherein the metallized strip loop 313 is in the form of an ellipse.

Referring further to FIGS. 1A and 1B, the conductive co-axial similarly shaped conductive metallized strip loops 13 are electrically interconnected by a plurality of conductive vias 15 that extend through the planar dielectric layers 11 that are between adjacent conductive strip loops 13. Each conductive via passes through a respective dielectric insulating layer that separates adjacent conductive strip loops 13, and a plurality of conductive vias are distributed along adjacent conductive strip loops, as schematically illustrated in FIG. 1 for the conductive rectangles respective disposed on the first dielectric insulating layer and the second dielectric insulating layer. The spacing between conductive vias 15 in each layer is preferably no greater than one-fourth of the wavelength at the highest operating frequency.

A horn antenna in accordance with the invention effectively comprises a plurality of similarly shaped conductive metallized strip loops respectively disposed on respective dielectric insulating layers which are laminarly stacked. The similarly shaped conductive strip loops are centered on an axis that is orthogonal to the planar extent of the planar dielectric insulating layers, and are of incrementally increasing size starting with the conductive strip loop disposed that is closest to the bottom layer of the stack of dielectric insulating layers. The similarly shaped conductive strip loops are electrically interconnected by a plurality of conductive vias. The similarly shaped conductive strip loops are of an appropriate closed figure, such as the sides of a polygon or a curved shape.

Figure 5A:
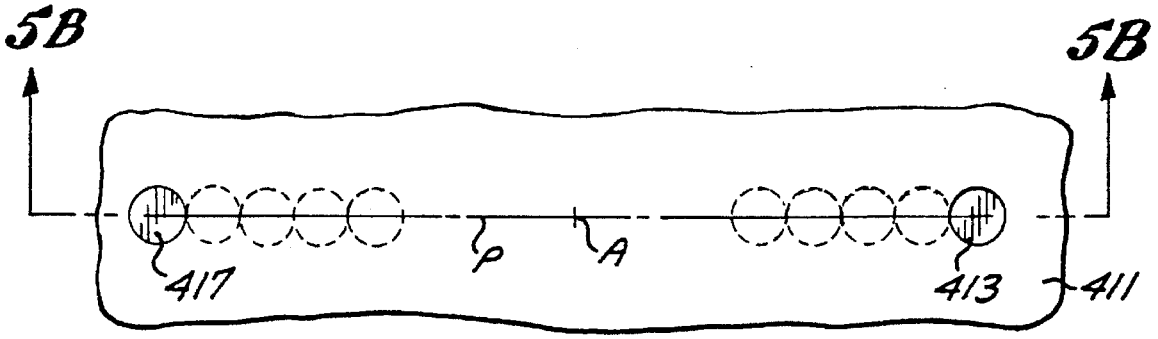
FIGS. 5A and 5B schematically illustrates a flared notch antenna in accordance with the invention.
Figure 5B:
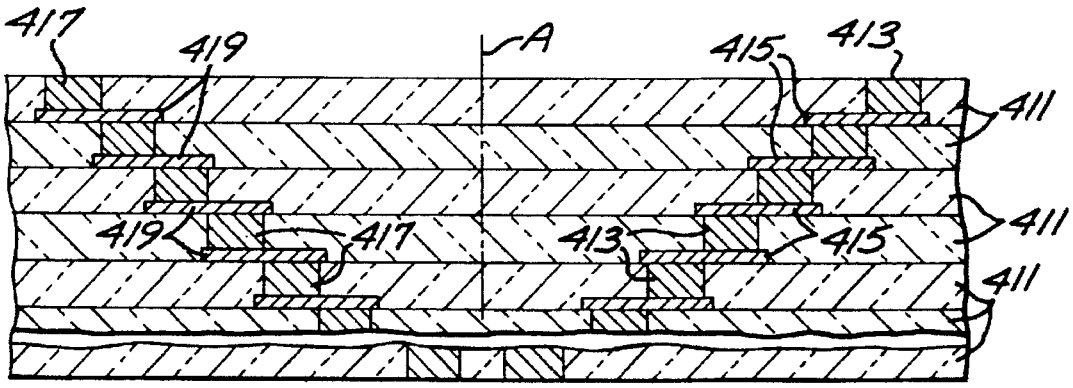

Referring now to FIGS. 5A and 5B, set forth therein are a simplified top plan view and an elevational schematic cross sectional view of an illustrative example of a flared notch antenna structure in accordance with the invention. The flared notch antenna structure includes a plurality of planar dielectric insulating layers 411 stacked in laminar fashion to form a substrate. The planar dielectric insulating layers are arranged in a sequence from a bottom layer to a top layer, and a first plurality of conductive vias 413 are formed in each of a plurality of contiguous ones of the dielectric insulating layers. The conductive vias are spaced at incrementally increasing distances from a central axis A that is orthogonal to the planar extent of the dielectric insulating layer 411, starting with the lowermost conductive via 413, wherein the lowermost conductive via 413 is lowest in the stack of insulating layers and closest to the bottom insulating layer, whereby the lowermost conductive via 413 is closest the central axis A, and are co-planar with the central axis A in the sense that the centers of conductive vias 413 and the central axis A are co-planar in a plane P, as represented by a line in FIG. 5A, wherein the plane P contains the central axis A and is orthogonal to the planar extent of the dielectric insulating layers and orthogonal to the plane of the FIG. 5A. Thus, the plurality of conductive vias 413 are laterally offset relative to each other and form a slanted column of conductive vias that slants away from the central axis with distance from the lowermost conductive via 413. A plurality of metallization strips 415 electrically interconnect the conductive vias 413.

The flared notch structure of FIGS. 5A and 5B further includes a second plurality of conductive vias 417 respectively formed in each of the contiguous ones of the insulating layers in which the conductive vias 413 are formed, wherein the centers of the conductive vias 417 are in the predetermined plane P such that the conductive vias 417 are coplanar, and the conductive vias 413 and the conductive vias 417 are all coplanar. The conductive vias 417 are spaced from the axis A at incrementally increasing distances starting with the lowermost conductive via 417, such that the lowermost conductive via is closest to the axis A. The incrementally increasing distances by which the conductive vias 417 are spaced from the axis A are substantially identical to the incrementally increasing distances by which the conductive vias 413 are spaced from the axis A, such that the conductive vias 413, 417 are disposed in pairs on a plurality of contiguous insulating layers, and wherein each of the conductive vias 413,417 on an insulating layer are equidistant from the axis A. Thus, the second plurality of conductive vias 417 are laterally offset from one another and form a slanted column of conductive vias that slants away from the central axis A with distance from the lowermost conductive via 417. The second plurality of conductive vias 417 slant in a direction opposite the direction in which the first plurality of conductive vias 413 slant, and the first plurality of conductive vias 413 and the second plurality of conductive vias 417 form a truncated generally V-shaped structure that resembles a V without a vertex. A second plurality of metallization strips 419 formed on the insulating layers electrically interconnect the second plurality of conductive vias 417.

In the flared notch antenna of FIGS. 5A and 5B, the slanted column of conductive vias 413 and the interconnecting metallization strips 415 form one conductive edge of the flared notch antenna, while the slanted column of conductive vias 417 and the interconnecting metallization strips 419 form the other conductive edge of the flared notch antenna. The slanted columns of conductive vias 413, 417 are in the form of a flared notch, and the particular taper or shape of the flare of the flared notch is determined by the contour of the slanted column of conductive vias 413, and the contour of the slanted column of conductive vias 417. For example, the contour of each of the slanted columns can be linear, exponential or otherwise curved.

The flared notch antenna of FIGS. 5A and 5B is basically comprised of respective pairs of co-planar conductive vias 413,417 respectively formed in each of the insulating layers 411, each of the conductive vias of each pair being equidistant from the central axis A and diametrically opposite each other relative to the central axis A. The spacing between each of the conductive vias 413, 417 of each pair increases incrementally starting with the pair of conductive vias 413,417 that is lowermost in the stack of dielectric insulating layers, such that the lowermost conductive vias are closest to the axis A. The first plurality of conductive vias 413 on one side of the central axis A are electrically interconnected by conductive metallization traces 415, while the second plurality of conductive vias 417 on a diametrically opposite side of the central axis A are electrically interconnected by conductive metallization traces 419.

The antenna structures in accordance with the invention are made, for example, pursuant to low temperature cofired processing such as disclosed in "Development of a Low Temperature Co-fired Multilayer Ceramic Technology," by William A. Vitriol et al., 1983 ISHM Proceedings, pages 593–598; "Processing and Reliability of Resistors Incorporated Within Low Temperature Co-fired Ceramic Structures," by Ramona G. Pond et al., 1986 ISHM Proceedings, pages 461–472; and "Low Temperature Co-Fireable Ceramics with Co-Fired Resistors," by H. T. Sawhill et al., 1986 ISHM Proceedings, pages 268–271.

In accordance with low temperature co-fired processing, vias are formed in a plurality of green thick film tape layers at locations defined by the desired via configurations of the desired multilayer circuit. The vias are filled with the appropriate fill material, for example, by screen printing. Conductor metallization for conductive traces including the antenna conductor strips are then deposited on the individual tape layers by screen printing, for example, and materials for forming passive components are deposited on the tape layers. The tape layers are laminated and fired at a temperature below 1200 degrees Celsius (typically 850 degrees Celsius) for a predetermined length of time which drives off organic materials contained in the green ceramic tape and forms a solid ceramic substrate.

Antenna structures in accordance with the invention can also be implemented with other technologies for forming unitized multilayer circuit structures, including for example high temperature co-fired ceramics, hard ceramic multilayer single firing technology, and a laminated soft substrate approach.

The foregoing has been a disclosure of notch and horn antenna structures that are inexpensive, space efficient, and suitable applications that have stringent space requirements such as conformal phased array applications.

Although the foregoing has been a description and illustration of specific embodiments of the invention, various modifications and changes thereto can be made by persons skilled in the art without departing from the scope and spirit of the invention as defined by the following claims.

What is claimed is:

1. A microwave horn antenna structure, comprising:

a plurality of planar dielectric insulating layers stacked in laminar fashion so as to have a bottom layer and a top layer;

respective similarly shaped conductive trace loops disposed on a plurality of contiguous ones of said insulating layers, said conductive traces being centered on an axis perpendicular to the planar extent of said insulating layers and being of incrementally increasing size from a lowermost conductive trace loop to an topmost conductive trace loop; and a plurality of conductive vias extending through said planar dielectric layers for electrically interconnecting said respective conductive trace loops.

2. The microwave horn antenna of claim 1 wherein each of said similarly shaped conductive trace loops comprises sides of a polygon.

3. The microwave horn antenna of claim 1 wherein each of said similarly shaped conductive trace loops comprises a curved closed figure.

4. The microwave horn antenna of claim 3 wherein each of said similarly shaped conductive trace loops comprises a circular conductive trace loop.

5. The microwave horn antenna of claim 3 wherein each of said similarly shaped conductive trace loops comprises an elliptical conductive trace loop.

6. A flared notch antenna comprising:

a plurality of planar dielectric insulating layers stacked in laminar fashion so as to have a bottom layer and a top layer;

first conductive vias respectively formed in a plurality of contiguous ones of said insulating layers, said first conductive vias being coplanar such that the centers thereof are in a predetermined plane that is perpendicular to the planar extent of said insulating layers, and further being spaced at incrementally increasing distances from a predetermined axis perpendicular to the planar extent of said dielectric insulating layers and contained in said predetermined plane, starting with a lowermost conductive via, such that the lowermost conductive via is closest to said predetermined axis;

second conductive vias respectively formed in said contiguous ones of said insulating layers, said second conductive vias being coplanar such that the centers thereof are in said predetermined plane, and further being spaced from at incrementally increasing distances said predetermined axis, starting with a lowermost second conductive, such that said lowermost conductive via is closest to said predetermined axis, said incrementally increasing distances being substantially identical to the incrementally increasing distances by which said first conductive vias are spaced from said predetermined axis, such that one of said first conductive vias and one of said second conductive vias are disposed in each of contiguous ones of said insulating layers, and wherein each of said first and second conductive vias in each of said contiguous ones of said insulating layers are equidistant from said predetermined axis;

first metallization strips formed on said insulating layers for electrically interconnecting said first conductive vias; and second metallization strips formed on said insulating layers for electrically interconnecting said second conductive vias.

7. A flared notch antenna comprising:

a plurality of planar dielectric insulating layers stacked in laminar fashion so as to have a bottom layer and a top layer;

first conductive vias respectively formed in said dielectric insulating layers, said first conductive vias arranged in a first slanted column;

second conductive vias respectively formed in said dielectric insulating layers such that one of said first conductive vias and one of said second conductive vias are formed in each of said planar dielectric insulating layers, said second conductive vias arranged in a second slanted column;

said first slanted column and said second slanted column forming a flared notch structure;

first metallization strips formed on said insulating layers for electrically interconnecting said first conductive vias; and second metallization strips formed on said insulating layers for electrically interconnecting said second conductive vias.

* * * * *